US006713991B1

(12) United States Patent
McCallum

(10) Patent No.: US 6,713,991 B1
(45) Date of Patent: Mar. 30, 2004

(54) BIPOLAR SHUNT REGULATOR

(75) Inventor: Jeffrey David McCallum, Cayucos, CA (US)

(73) Assignee: Rantec Power Systems Inc., Los Osos, CA (US)

( * ) Notice: Subject to any disclaimer, the term of this patent is extended or adjusted under 35 U.S.C. 154(b) by 0 days.

(21) Appl. No.: 10/131,345

(22) Filed: Apr. 24, 2002

(51) Int. Cl.[7] ..... G05F 1/613
(52) U.S. Cl. ..... 323/226
(58) Field of Search ..... 323/223–226, 323/229, 231, 233

(56) References Cited

U.S. PATENT DOCUMENTS 4,893,070 A * 1/1990 Milberger et al. ..... 323/270
5,721,483 A * 2/1998 Kolluri et al. ..... 323/224
5,949,122 A 9/1999 Scaccianoce
6,008,549 A 12/1999 Cooper et al.
6,222,350 B1 4/2001 Mosley
6,452,366 B1 * 9/2002 Hwang ..... 323/225
6,490,142 B1 * 12/2002 Smith ..... 361/104

* cited by examiner

*Primary Examiner*—Matthew V. Nguyen
(74) *Attorney, Agent, or Firm*—Hickman Palermo Truong & Becker LLP

(57) ABSTRACT

Embodiments of the present invention are directed to a high voltage shunt regulator. The shunt regulator may receive input power of positive or negative polarity and may have two conduction paths. A conduction path may be engaged when the input power is of the proper polarity and the output voltage (or some other characteristic to be regulated) does not match a desired value. The conduction path may include a solid-state shunt in the form of a transistor stack. In embodiments of the invention, the transistor stack includes a number of serially-connected bipolar junction transistors (BJTs), one of which may be operated in the linear region and others of which may be either saturated or in the off state. Voltage regulators may be provided in each stage of the transistor stack to prevent excessive voltage from being applied across the terminals of a corresponding transistor and to provide a shunt path for current when the corresponding transistor is in the off state.

52 Claims, 2 Drawing Sheets

BIPOLAR SHUNT REGULATOR

BACKGROUND

In the field of high voltage power conversion, there are a number of methods that can be employed to design a single polarity solid state shunt regulator that is controlled from a low voltage signal. However, in some applications, a regulator is required to accept a high voltage input that has a changing polarity relative to ground and regulate the output to a given magnitude of the same polarity as the input. Typically, circuitry designed around vacuum tube technology has been used to satisfy this requirement.

An example of a single polarity shunt regulator is provided in U.S. Pat. No. 6,222,350 to Mosley ("the Mosley reference"). The high voltage shunt regulator including a series of Zener diodes connected in series with a thermal compensation circuit that includes a plurality of MOSFET switches and resistive voltage dividers. When a voltage in excess of the Zener threshold voltage is applied to the series of Zener diodes from a high voltage source, the Zener diodes conduct substantially all of the current applied at the input terminal to the output terminal. However, because the threshold voltage of a Zener diode decreases as the temperature of the Zener diode increases (which happens as the Zener diode conducts current), the MOSFETs of the thermal compensation circuit must be engaged to provide a compensatory voltage drop so that the diversion of current takes place at the appropriate voltage level. U.S. Pat. No. 5,949,122 to Sccaccionoce discloses a similar system using bipolar junction transistors instead of MOSFETs. Although these references discuss the use of shunt regulators in high voltage applications, the disclosed regulators are unsuitable for use in dual polarity applications. Accordingly, neither discusses the need for quick switching to accommodate changes in the polarity of the high voltage source.

DETAILED DESCRIPTION

Embodiments of the present invention are directed to a high voltage solid state bipolar input and output shunt regulator. According to the present invention, the output of the shunt regulator automatically tracks the polarity of the input from a high voltage source, without the need of any polarity-indicating input. Current may be shunted in either a positive or negative manner in order to maintain regulation of the output voltage. The shunt regulator of the present invention may combine a first conduction path to act as a shunt when the input from the high voltage source has a positive polarity and a second conductive path to act as a shunt when the input from the high voltage source has a negative polarity.

Figure 1:
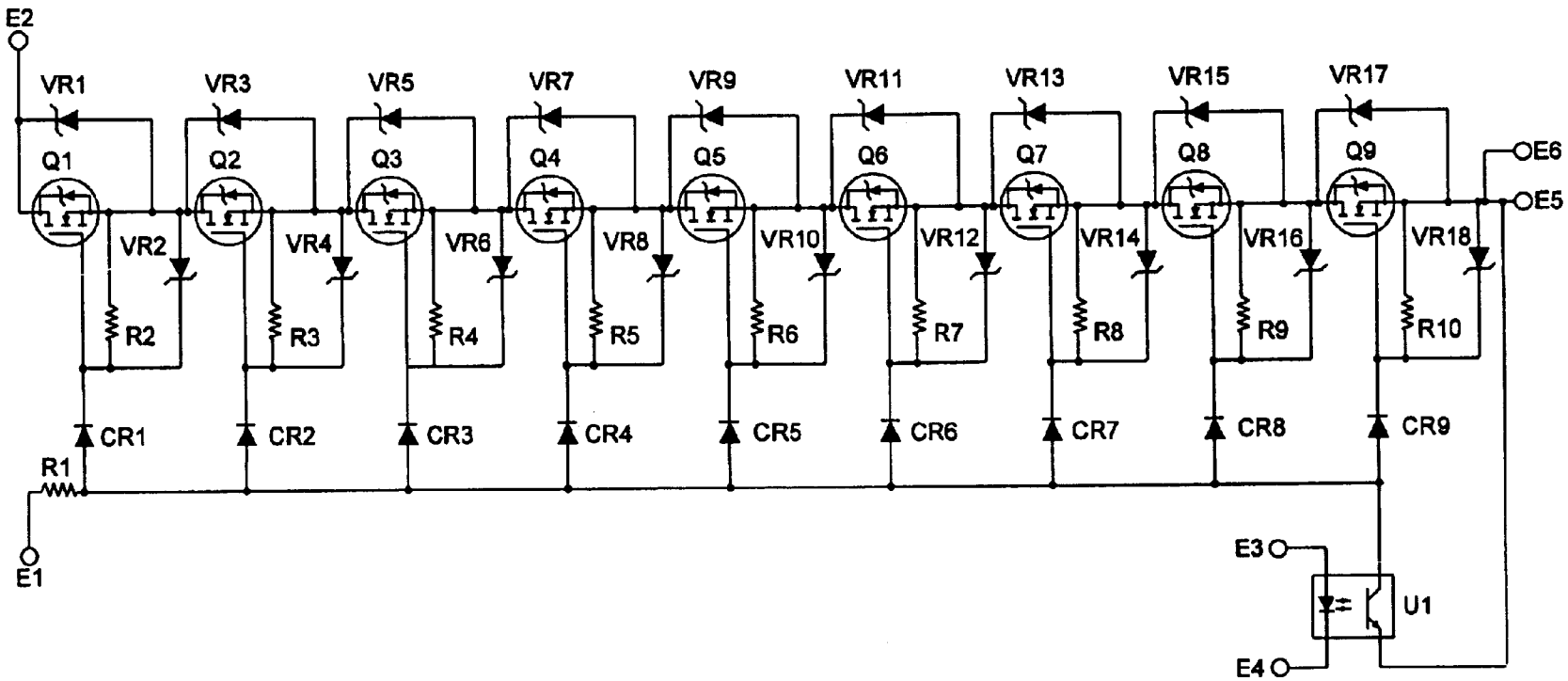
FIG. 1 is a circuit schematic diagram depicting a solid state high voltage switch according to an embodiment of the present invention.

In an embodiment of the invention, each conduction path may include a solid-state switch coupled between the high voltage input terminal and ground. FIG. 1 depicts an isolated high voltage MOSFET transistor stack that may be used as a solid-state switch according to embodiments of the present invention. The solid-state switch of FIG. 1, as shown, may be used as a switch element in which a control signal causes all of the transistors to either be fully enhanced (or closed) or fully "off" (or open). As discussed in greater detail with respect to FIG. 2, the solid-state switch shown in FIG. 1 may be slightly modified for advantageous use in a shunt regulator application. In the particular embodiment shown, the transistor stack consists of nine stages, each including a transistor Q1 to Q9. While a MOSFET transistor is preferred for a switching element, other types of FETs or other transistors may be substituted. The number of transistor stages may be increased or decreased depending on the maximum input voltage the solid-state switch will receive. The high voltage conduction path of the switch is from a high voltage input terminal E2 to an output terminal E6 when the switch is in the closed mode. In the open mode, the switch will block transmission of a positive (as measured from terminal E2 to E6) voltage from the high voltage input terminal E2 to the output terminal E6. An isolated bias voltage may be connected between bias terminal E1 and bias terminal E5. Bias terminal E5 may be coupled to the output terminal E6. Voltage regulators VR1, VR3, VR5, VR7, VR9, VR11, VR13, VR15 and VR17 (shown as zener diodes) may be provided to prevent damage to a transistor from the application of an excessive voltage across its drain and source terminals.

The switch may be operated by supplying a biasing voltage at a bias terminal E1 relative to bias terminal E5 of a magnitude great enough to fully enhance the gate of transistor Q9 such that current is allowed to flow from the drain terminal to the source terminal of the transistor. In alternative embodiments in which bipolar junction transistors (BJTS) are used, a current is supplied to the base terminal of the BJT to induce current flow between a collector terminal and an emitter terminal. Current regulating elements CR1 to CR9 (shown as diodes in FIG. 1) may be used to prevent current flowing into the biasing stage when transistors Q1 to Q9 are open.

In embodiments of the invention, the control switch U1 may be an optocoupler that includes a photodiode and a phototransistor, as shown in FIG. 1. While an optocoupler is advantageous because it provides for isolation of the control signal from the phototransistor and the remainder of the circuit, other types of switches may be used. The biasing voltage may be applied at the bias terminal E1 relative to bias terminal E5 and a control signal drives current into control terminal E3 and through the photodiode to return through control terminal E4. As a result, the photodiode may transmit light to the phototransistor, maintaining the control switch U1 in a saturated state, i.e., the control switch is in the closed or "ON" state. When the current driven through the photodiode by the control signal is removed, the phototransistor will turn to the open or "OFF" state. In alternative embodiments of the invention, the control switch U1 may be configured so that the open or "OFF" state is achieved when a "high" control signal is applied and the closed or "ON" state is achieved when no or a "low" control signal is applied. Alternatively, in embodiments of the invention, control switch U1 may be removed and the state of the solid-state switch may be controlled by directly turning on or off the biasing voltage connected between bias terminal E1 and bias terminal E5.

In alternative embodiments of the invention, other mechanisms may be used as the control switch U1, such as electrical coupling elements (e.g., a diode and transistor), switches, rectifiers, relays, resonant circuit elements (e.g., transformers), or the like. However, it may be advantageous to use an optocoupler as the control switch U1 in applications where isolation of the control signal from the controlled load and fast response to changes in the control signal are desirable. It should be further understood that while use of an optocoupler including a phototransistor is shown in FIG. 1, different types of optocouplers, such as those including phototriacs, photodarlingtons or light-activated rectifiers, may also be used.

In the embodiment shown in FIG. 1, with the control switch U1 in saturation (i.e., in the closed or "ON" state), the gate-source voltage of transistor Q9 will be insufficient to bring the transistor Q9 into enhancement mode. Current from the biasing terminal E1 will be drained off to bias terminal E5 (which may be electrically coupled to the output terminal E6) rather than passing through the drain path resistor R10. Therefore, the solid-state switch will remain in the "open" state. The solid-state switch may then be "closed" by removing the control signal from (or applying a "low" control signal to) the control switch U1, thereby opening the control switch U1. Opening the control switch allows the gate of transistor Q9 to become enhanced by the biasing voltage and thereby reduces the drain source impedance of Q9 to effectively a short. Where transistor Q9 is a FET, the transistor Q9 may include an inherent capacitance between the gate and source terminals, and enhancement may occur when the biasing voltage is applied to the gate terminal. In alternative embodiments, such as those in which a BJT is used for transistor Q9, a biasing element may be connected between terminals of the BJT to forward bias the base-emitter junction. The impedance of Q9 transitions from high to low, allowing current to flow from the bias terminal E1, through drain path resistor R9 and transistor Q9 to the output terminal E6. As a result, the biasing voltage may be applied to the gate terminal of transistor Q8 and transistor Q8 may also become enhanced. This cascading process continues up the stack until all of the transistor elements Q1 to Q9 are fully enhanced, at which time the solid-state switch is considered closed. Voltage-regulating Zener diodes VR2, VR4, VR6, VRS, VR10, VR12, VRl4, VRI6 and VR18 may be chosen so that their "breakdown" voltage is less than the maximum voltage difference permissible between the gate and source terminals at which transistors Q1 through Q9 can operate.

Where transistors Q1 to Q9 are FETs, drain path resistors R2 to R10 may be coupled across the gate and source terminals of the transistors Q1 to Q9 as shown in FIG. 1. When the solid-state switch transitions from the closed state to the open state, charge built up at the gate terminal of each FET may be drained to prevent the stage from closing again until the biasing voltage is reapplied. Thus, during this transition, charge from the gate terminal of each transistor Q1 to Q9 may be drained away as current passing through the drain path resistors R2 to R10 to the output terminal E6, since current may be prevented from draining through the current-regulating diodes CR1 to CR9. As previously discussed, in alternative embodiments in which the transistors Q1 to Q9 are BJTs, resistors may be coupled across the terminals of the transistors Q1 to Q9 to act as biasing elements. Furthermore, in alternative embodiments of the invention, the transistors Q1 to Q9 and control switch U1 may be configured such that the transistors Q1 to Q9 transition to the closed state when the control switch U1 closes.

Figure 2:
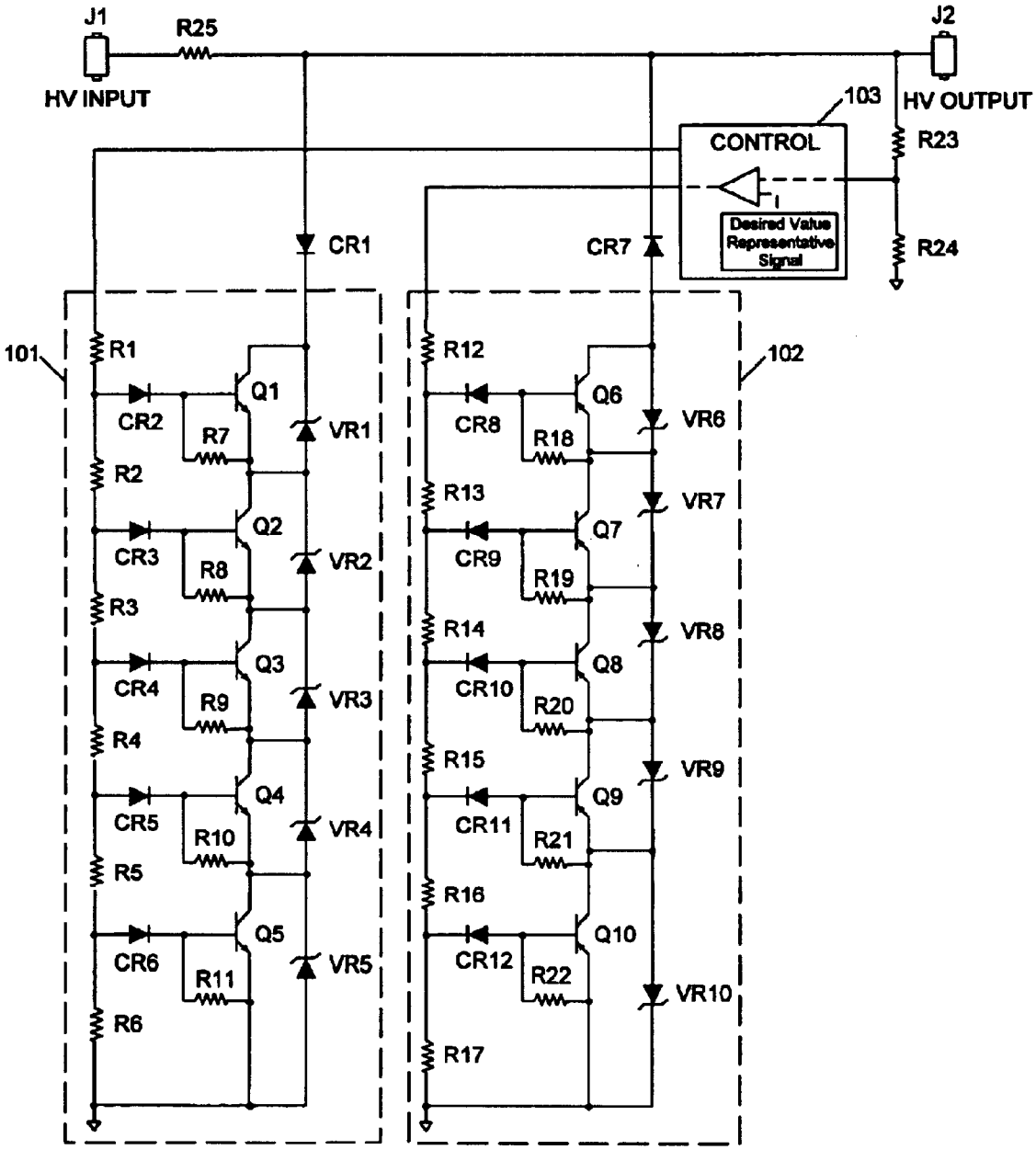
FIG. 2 is a circuit schematic depicting a solid state high voltage bipolar shunt regulator according to an embodiment of the present invention.

FIG. 2 depicts a high voltage shunt regulator according to an embodiment of the present invention. As shown, the shunt regulator may regulate the output voltage provided at the output terminal J2. A high voltage source may be connected at the input terminal J1. For a positive input voltage, current flows from the input terminal J1 to the output terminal J2 through a resistor R25. Resistors R23 and R24 may be selected such that their combined resistance is much greater than the equivalent load impedance connected to J2. Under this condition, it may be assumed that the current shunted from the input terminal J1 through resistors R23 and R24 is negligible. As a result, the maximum output voltage at J2 may be approximately equal to the input voltage received at input terminal J1 minus the product of the output current ($I_{out}$) and the resistance of resistor R25. Furthermore, in embodiments of the invention, resistor R23 may be chosen to have a resistance significantly greater than that of resistor R24 so as to produce a relatively low voltage signal at the input terminal to control circuit 103 that is still proportional to the output voltage.

In order to regulate the output voltage ($V_{out}$) to a desired output voltage less than this maximum output voltage when the high voltage source providing the input power has a positive polarity, current may be shunted to ground through a first conduction path including current regulator CR1 (shown as a diode) and its corresponding solid-state shunt 101. Shunting current through the first conduction path may increase the voltage drop across resistor R25 such that the output voltage $V_{out}=Vin-R_{25} * (I_{out}+I_{shunt})$, where $R_{25}$ represents the resistance of resistor R25, since the sum of the output current and the shunted current will generally be larger than the output current when no current is shunted through the first conduction path. Conversely, in the negative polarity condition, current may be shunted from ground to the input terminal J1 through a second conduction path including current regulator CR7 (also shown as a diode) and its corresponding solid-state shunt 102.

The solid-state shunt 101 (as well as the solid-state shunt 102 in the alternate conduction path) may be a transistor stack type solid-state switch similar to the one shown in FIG. 1. However, as shown in FIG. 2, the solid-state shunts 101 and 102 may differ from those shown in FIG. 1 insofar as the control switch U1 used in the device of FIG. 1 may be incorporated into the control circuit 103, such that the control circuit 103 directly produces or removes the biasing voltage to cause transistors in the transistor stack to open and close in response to detecting that the output voltage exceeds the desired voltage. Furthermore, as shown in FIG. 2, terminals E5 and E6 of the solid-state switches 101 and 102 (as identified in FIG. 1) may be coupled to ground. The transistors Q1 to Q5 and Q6 to Q10 in the transistor stacks themselves may be BJTs instead of FETs (as shown in FIG. 1). Accordingly, base resistors R1 to R6 and R12 to R17 may be included with each stage, such that when a biasing voltage is applied by the control circuit, a portion of the current flowing through the base resistor R1 to R6 and R12 to R17 for a particular stage will be diverted through the current regulators CR2 to CR6 and CR8 to CR12 toward the base terminals of the transistor Q1 to Q10 for that stage and the remainder of the current will be passed through the base resistor R1 to R6 and R12 to R17 for the next stage. Moreover, resistors R7 to R11 and R18 to R22 may be used as biasing elements as well as drain and/or noise filtering elements as described in connection with the FET embodiment shown in FIG. 1. Accordingly, a portion of the current passing through current regulators CR2 to CR6 and CR8 to CR12 may be passed through these resistors R7 to R11 and R18 to R22 to ensure that the a sufficient potential difference exists (or does not exist, depending on the amount of current sent through the biasing resistor) at the base-emitter junction of a particular transistor Q1 to Q10 of a transistor stack. Moreover, the solid-state shunts 101 and 102 may be biased such that at least one transistor element of the stack is operated in its linear region.

The control circuit 103 may monitor the difference between the desired output voltage and the actual output voltage, and adjust the drive signal (e.g., the biasing voltage in the embodiment shown in FIG. 2) for the solid-state shunts 101 and/or 102 accordingly. In the embodiment shown, that magnitude of the biasing voltage, as well as the amount of load present may determine how many of the transistors Q1 to Q10 in a solid-state shunt 101 and 102 will be closed, while the polarity of the biasing voltage may determine whether transistors Q1 to Q10 in the solid-state shunt 101 and 102 of the positive or negative conduction path are closed. For example, the control circuit 103 may produce a positive biasing voltage that is capable of developing a base current that is sufficient to saturate transistors Q3, Q4 and Q5 of solid-state shunt 101 and will not cause any of the transistors Q6 to Q10 in solid-state shunt 102 in the negative conduction path to close. In this scenario, current may be shunted away from output terminal J2 to ground through the closed transistors Q3, Q4 and Q5 and voltage regulators VR1 and VR2. As is evident from this example, the solid-state shunts 101 and 102 as shown in FIG. 2 may provide the added benefit of acting as inherent output voltage clamps, because according to this example, the output voltage at output terminal J2 may be clamped to a voltage approximately equal to the sum of the voltage drops across the voltage regulators of stages of the solid-state shunt in which the transistors are open (i.e., the sum of the zener voltages of voltage regulators VR4 and VR1 in the example given).

In embodiments of the invention in which the control circuit 103 provides a biasing voltage to the solid-state shunts 101 and 102 as a drive signal, such as that shown in FIG. 2, the magnitude of the biasing voltage may depend upon the difference between the output voltage and a desired output voltage level. In particular embodiments of the invention, this may be accomplished via the use of an error amplifier (not shown). As shown in FIG. 2, the output voltage may be divided down by resistors R23 and R24 to a level low enough to be inputted into a terminal of an error amplifier. A voltage representative of the desired output voltage level (e.g., the desired output voltage level divided by the same ratio by which the output voltage is divided for input to the error amplifier) may be input to the other terminal of the error amplifier. If the magnitude of the output voltage increases beyond the desired output voltage level, the control circuitry may raise the magnitude of the biasing voltage accordingly. The increase in biasing voltage may cause a solid-state shunt 101 or 102 to shunt more current (by closing additional transistors Q1 to Q10 within the solid-state shunt 101 or 102) and thereby decrease the magnitude of the output voltage. Conversely, if the magnitude of the output voltage drops below the desired output voltage level, the control circuitry may reduce the amount of biasing voltage applied to the solid-state shunt 101 and 102 on the stack, thereby opening one or more of transistors Q1 to Q10 in solid-state shunt 101 or 102 to cause the solid-state shunt 101 or 102 to shunt less current. This allows the magnitude of the output voltage to increase. The biasing voltage may be applied to both solid-state switches 101 and 102 even though only one conduction path may shunt current. In embodiments of the invention, the control circuit 103 may include two separate error amplifiers, one for each polarity condition. Furthermore, in embodiments of the invention, the desired output voltage level may be provided by an internal or external source and may be fixed or adjustable. In embodiments of the invention, each conduction path may have an independent control circuit for supplying the biasing voltage.

As shown in FIG. 2, when the magnitude of the output voltage is equal to the sum of the zener voltages of voltage regulators VR1 to VR5 in the positive polarity condition or VR6 to VR10 in the negative polarity condition, a conduction path will shunt current even though none of the transistors Q1 to Q5 or Q6 to Q10 may be closed. Accordingly, the number of stages in a solid-state switch 101 or 102 or the characteristics of the voltage regulators (e.g., zener voltages) in each stage may be chosen based on the desired level for output voltage regulation. Furthermore, the characteristics of the voltage regulator used in a stage may depend in part on the characteristic of the transistor used in a stage (e.g., a zener voltage may be selected to be less than the level of collector-emitter junction voltage at which a corresponding BJT may be damaged).

In some embodiments of the invention, the magnitude of the biasing voltage applied to the solid-state switch 101 in the positive polarity conduction path may be greater or less than the magnitude of the biasing voltage provided to the solid-state switch 102 in the negative polarity conduction path. Furthermore, the number of stages in each of the solid-state switches need not be the same. The number of stages in each solid-state switch may depend on the symmetry of the high voltage source, as well as the symmetry or relevant characteristics of the transistor elements used in each solid-state switch.

One or more of the individual transistors Q1 to Q10 of the solid-state shunts 101 and 102 may be operated in the linear region. As the desired output voltage level is reduced in magnitude, the transistor(s) Q1 to Q10 in operation shifts up the stack. As an example, in a positive polarity condition, the desired output voltage may range from 1 Volt (V) to 1000 V. Accordingly, voltage regulators VR1 through VR5 may be 200 V zener diodes. The output may be regulated by comparison of the divider voltage that is input to the control circuit (representative of the output voltage) against a variable reference voltage representative of a variable desired output voltage. Initially, the desired output voltage may be set at 1000 V and the transistors Q1 to Q5 may not conduct any current in order to maintain the output voltage at the desired level. As the reference voltage is adjusted down to correspond to a desired voltage limit within the 800 V to 1000 V range, transistor Q5 may begin operating in the linear region, because the voltage difference at the collector-emitter junction of transistor Q5 will be high (i.e., the amount by which the output voltage exceeds 800 V in this example). The control circuit 103 may also provide a large biasing voltage (since the biasing voltage may be approximately proportional to the difference between the output voltage and the desired output voltage), causing a relatively large current to be shunted through transistor Q5 and voltage regulators VR1 to VR4. When the difference between the output voltage and the sum of the zener voltages of voltage regulators VR1 to VR4 is sufficiently small, the transistor Q5 may reach its saturation level, at which time voltage regulator VR5 may be effectively shorted by transistor Q5. During the linear operation of transistor Q5, transistors Q1 to Q4 may be off and the conduction path to transistor Q5 is through series elements VR1 to VR4. While transistor Q5 is operating in the linear region, the voltage of its collector terminal, which is also the voltage of the emitter terminal of transistor Q4 up the stack, may be relatively high, maintaining current regulator CR5 in a reverse-biased condition and preventing the base-emitter junction of transistor Q1 from becoming biased. But as transistor Q5 approaches saturation the voltage of its collector terminal, and that of the emitter terminal of transistor Q4, may drop to a relatively low level. Over the next region, 800V to 600V, transistor Q5 may remain saturated and transistor Q4 may operate over its linear region, while transistors Q1 through Q3 remain off and current is conducted through voltage regulators VR1 to VR3. As the desired output voltage continues to drop, this transition may continue up the stack until all elements are fully saturated. Thus, the voltage regulators VR1 to VR10 may protect the corresponding transistors Q1 to Q10 from overvoltage conditions and provide a shunt-current path for transistors that are in the off state.

As the power received at input terminal J1 changes polarity (for example, from positive to negative), the conduction path shunting current will automatically switch from the positive shunt element (e.g., the first conduction path as illustrated in FIG. 2) to the negative shunt element (e.g., the second conduction path as illustrated in FIG. 2). When the polarity of the input power received at input terminal J3 is stable and of a roughly constant magnitude, the output power transmitted at output terminal J2 may also maintain an approximately constant magnitude. At this magnitude, the first conduction path may shunt excess current through solid-state switch 101 to maintain the output voltage at the desired value. As the input starts to transition from this stable positive magnitude towards zero, the solid-state switch 101 in the positive first conduction path may shunt less and less current in order to keep the output regulated. When the shunt current through current-regulator CR1 effectively reaches zero, the output voltage may no longer remain regulated and may start to drop in magnitude with the input voltage. As the input voltage transitions to negative polarity, it may reach a magnitude large enough to once again support output regulation. At this point, current may again be shunted, but from ground via the negative second conduction path through the current regulator CR7 and its corresponding solid-state switch 102.

In the embodiments described above, the output voltage may be regulated to the same magnitude when either a positive input polarity or a negative input polarity is present without the need for any external polarity reversal circuitry. It will be readily understood by those in the art that the embodiments described above may easily be modified for other regulation schemes, e.g., regulation of current, power or some other output power characteristic rather than voltage regulation. This may be accomplished by, for example, modifying the control circuit 103 to monitor and regulate output current, output power or another output power characteristic rather than output voltage. Furthermore, in embodiments of the invention, polarity reversal may be accomplished in either a symmetrical or non-symmetrical fashion. Accordingly, the conduction path for shunting current in the negative polarity condition may be engaged when the magnitude of the output voltage exceeds a first desired value and the conduction path for shunting current in the positive polarity condition may be engaged when the magnitude of the output voltage exceeds a second, different desired value. Accordingly, the number of stages in each of the solid-state shunts 101 and 102 may not be identical and the characteristics of the voltage regulators VR1 to VR5 may be different from those of voltage regulators VR6 to VR10.

While the description above refers to particular embodiments of the present invention, it should be readily apparent to those in the art that a number of modifications may be made without departing from the spirit thereof The accompanying claims are intended to cover such modifications as would fall within the true spirit and scope of the invention. The presently disclosed embodiments are, therefore, to be considered in all respects as illustrative and not restrictive, the scope of the invention being indicated by the appended claims rather than the foregoing description. All changes that come within the meaning of and range of equivalency of the claims are intended to be embraced therein.

What is claimed is:

1. A shunt regulator for a high voltage power source, said high voltage power source capable of producing power having one of a first polarity and a second polarity opposite to said first polarity, said regulator comprising:

an input terminal coupled to said high voltage power source to receive input power therefrom;

an output terminal configured to provide a regulated output power characterized by an output power characteristic;

a first conduction path including a first solid-state shunt selectively engageable to shunt a variable amount of current away from said input terminal if the magnitude of said output power characteristic exceeds a first desired value and said input power has said first polarity; and a second conduction path including a second solid-state shunt selectively engageable to shunt a variable amount of current toward said input terminal if the magnitude of said output power characteristic exceeds a second desired value and said input power has said second polarity, and a control circuit configured to compare said output power characteristic to one of said first desired value and said second desired value, and further configured to engage one of said first solid-state shunt and said second solid-state shunt by transmitting a drive signal thereto.

2. The shunt regulator according to claim 1, wherein each of said first conduction path and said second conduction path are electrically coupled between said output terminal and ground.

3. The shunt regulator according to claim 1, wherein said first conduction path further includes a current regulator to prevent current from flowing through said first conduction path when said input power has said second polarity.

4. The shunt regulator according to claim 1, wherein said second conduction path further includes a current regulator to prevent current from flowing through said second conduction path when said input power has said first polarity.

5. The shunt regulator of claim 1, wherein said first desired value is substantially equal to said second desired value.

6. The shunt regulator according to claim 1, said control circuit including an error amplifier having a first terminal receiving a signal representative of said output power characteristic, and a second terminal receiving a signal representative of said desired value.

7. The shunt regulator according to claim 1, at least one of said first solid-state shunt and said second solid-state shunt including a plurality of transistors.

8. The shunt regulator according to claim 7, wherein at least one of said plurality of transistors is a bipolar junction transistor that operates in the linear region.

9. The shunt regulator according to claim 7, wherein each of said plurality of transistors is part of one of a plurality of stages in a transistor stack and further wherein the receipt of said drive signal causes one of said plurality of transistors at a first end of said transistor stack to operate in the linear region.

10. The shunt regulator according to claim 9, wherein each stage includes a current regulator.

11. The shunt regulator according to claim 10, wherein said current regulator is a diode.

12. The shunt regulator according to claim 9, wherein a first terminal of the transistor of a first one of said plurality of stages is coupled to a second terminal of the transistor of a second one of said plurality of stages.

13. The shunt regulator according to claim 9, wherein each of said plurality of stages includes a voltage regulator coupled between two terminals of said one of said plurality of transistors.

14. The shunt regulator according to claim 13, wherein said voltage regulator is a zener diode.

15. The shunt regulator according to claim 13, wherein current flows through said voltage regulator when said one of said plurality of transistors is in the off state.

16. The shunt regulator according to claim 7, wherein at least one of said plurality of transistors is a bipolar junction transistor that operates in the saturated region.

17. The shunt regulator according to claim 10, wherein the saturation of one of said plurality of transistors in said transistor stack causes at least one other transistor in said transistor stack to operate in the linear region.

18. The shunt regulator according to claim 1, wherein said drive signal is a biasing voltage of a magnitude proportional to the difference between the desired value and said output power characteristic.

19. The shunt regulator according to claim 1, further including an element coupled between said input terminal and said output terminal, wherein the difference between said input voltage and said output voltage is determined by the magnitude of said input current passing through said element.

20. The regulator according to claim 13, wherein said element is a resistor.

21. The regulator according to claim 1, wherein the amount of current shunted by one of said first conduction path and said second conduction path varies over a substantially continuous range.

22. The regulator according to claim 1, wherein said output power characteristic is one of a voltage, a current and a power.

23. A linear shunt regulator, comprising:

an input terminal for receiving an unregulated high voltage input power;

an output terminal for providing an output power having a regulated output power characteristic;

a ground terminal;

a plurality of transistors, one or more of which may be selectively engaged to shunt current between said input terminal and said ground terminal; and a control circuit configured to apply a drive signal to at least one of said plurality of transistors when the magnitude of said output power characteristic is not equal to a desired value.

24. The linear shunt regulator according to claim 23, said plurality of transistors including a first set of transistors configured not to shunt current between said input terminal and said ground terminal when said input power is of a first polarity.

25. The linear shunt regulator according to claim 24, further including a current regulator coupled to a terminal of at least one of said plurality of transistors to prevent current from being received at said terminal when said input power is of a first polarity.

26. The linear shunt regulator according to claim 23, wherein one of said plurality of transistors is a bipolar junction transistor.

27. The linear shunt regulator according to claim 26, wherein said bipolar junction transistor is operated in linear mode when current is being shunted between said input terminal and said ground.

28. The linear shunt regulator according to claim 26, wherein said bipolar junction transistor is saturated when current is being shunted between said input terminal and said ground.

29. The linear shunt regulator according to claim 26, wherein a resistor is coupled between two terminals of said bipolar junction transistor.

30. The linear shunt regulator according to claim 23, wherein current is shunted from said input terminal to said ground terminal.

31. The linear shunt regulator according to claim 23, wherein current is shunted to said input terminal from said ground terminal.

32. The linear shunt regulator according to claim 23, said control circuit including a first amplifier capable of receiving a first input signal indicative of said output power characteristic and a second input signal indicative of said desired value, and capable of producing said drive signal based on the difference between said first input signal and said second input signal.

33. The linear shunt regulator according to claim 32, said control circuit further including a second amplifier capable of receiving said first input signal and said second input signal, and capable of producing said drive signal based on the difference between said first input signal and said second input signal, wherein said first amplifier receives said first input signal and said second input signal if said output power is of a first polarity, and wherein said second amplifier receives said first input signal and said second input signal if said output power is of a second polarity.

34. The linear shunt regulator according to claim 23, further including a voltage regulator coupled to a terminal of one of said plurality of transistors such that current may flow through said voltage regulator when said transistor is in the off state.

35. The linear shunt regulator according to claim 23, wherein said plurality of transistors are coupled in series.

36. The linear shunt regulator according to claim 23, wherein said output power characteristic is one of a voltage, a current and a power.

37. A method of regulating a high voltage input said method comprising:

receiving an input power having at an input terminal;

providing an output power having a regulated output power characteristic at an output terminal;

determining the difference between said a current value of said output power characteristic and a desired value of said output power characteristic;

generating a drive signal based on said difference;

applying said drive signal to a solid-state shunt to cause a variable amount of current to be linearly shunted between said output terminal and ground.

38. The method according to claim 37, determining said difference including applying a first signal representative of said current value of said output power characteristic to a first terminal of an amplifier and applying a second signal representative of said desired value of said output power characteristic to a second terminal of said amplifier.

39. The method according to claim 37, wherein said solid-state shunt includes a transistor stack having a plurality of transistors.

40. The method according to claim 39, further including coupling said transistor stack between said output terminal and ground.

41. The method according to claim 40, wherein said transistor stack is coupled to said output terminal through a current regulator.

42. The method according to claim 37, wherein said input voltage has one of a first polarity or a second polarity.

43. The method according to claim 42, further including preventing current from being shunted through said solid-state shunt if said output voltage is of said second polarity.

44. The method according to claim 42, further including determining whether said output voltage is of said first polarity or said second polarity.

45. The method according to claim 42, further including determining said desired value of said output power characteristic based on the polarity of said output voltage.

46. The method according to claim 37, wherein said output power characteristic is one of a voltage, a current and a power.

47. A method of regulating a high voltage power source, said method comprising:

receiving an unregulated input voltage at an input terminal, said input voltage capable of having one of a positive polarity and a negative polarity;

providing a regulated output voltage at an output terminal;

determining the difference between the magnitude of said output voltage and a desired magnitude of said output voltage;

generating a drive signal based on said difference;

applying said drive signal to a first solid-state shunt to cause a variable amount of current to be shunted from said output terminal to ground if said input voltage has a positive polarity;

applying said drive signal to a second solid-state shunt to cause a variable amount of current to be shunted to said output terminal from ground if said input voltage has a negative polarity.

48. The method according to claim 47, wherein said output voltage has the same polarity as said input voltage.

49. The method according to claim 47, wherein one of said first solid-state shunt and said second solid-state shunt includes a plurality of transistors, and applying said drive signal including causing one of said transistors to conduct current.

50. The method according to claim 49, wherein one of said plurality of transistors is a bipolar junction transistor, and causing one of said transistors to conduct current including applying a biasing voltage to a junction of said bipolar junction transistor.

51. The method according to claim 49, applying said drive signal including operating said bipolar junction transistor in said linear region.

52. The method according to claim 49, applying said drive signal including saturating said bipolar junction transistor.

* * * * *